US005261308A

United States Patent [19]

Yamauchi

[11] Patent Number: 5,261,308

[45] Date of Patent: Nov. 16, 1993

[54] MOUTHPIECE OF FLUTE

[76] Inventor: Genhichi Yamauchi, 95, Satokomaki Yamakata, Kisogawacho, Haguri-gun, Aichi-ken, Japan

[21] Appl. No.: 1,467

[22] Filed: Jan. 7, 1993

[30] Foreign Application Priority Data

Jan. 20, 1992 [JP] Japan ..... 4-030091

[51] Int. Cl.[5] ..... G10D 7/02

[52] U.S. Cl. ..... 84/384; 84/383 R

[58] Field of Search ..... 84/383 R, 384, 398

[56] References Cited

U.S. PATENT DOCUMENTS

| | | | |
|---|---|---|---|
| 4,041,827 | 8/1977 | Daglis | 84/383 R |
| 4,058,046 | 11/1977 | Fajardo | 84/384 |
| 4,212,223 | 7/1980 | Runyon | 84/383 R |
| 4,896,579 | 1/1990 | Goosman | 84/384 |

*Primary Examiner*—Michael L. Gellner
*Assistant Examiner*—Patrick J. Stanzione

[57] ABSTRACT

In a mouthpiece of flute, a projective tongue piece is formed in a position where the inner surface of a hole on the side on which a lip is to be put meets the inner surface of a head pipe so as to form a bulgy rounded concaved surface which is made to bulge outwardly of the head pipe, so that the interior space of the pipe is divided by the projective tongue piece into two pats including an acoustic space and a fluid space. In order to make is possible to give a clear, vigorous, rich and loud sound easily as well as to give high-pitched tones without difficulty, the inner surface of the head pipe in the vicinity of the hole comprises a rounded raised portion which is so formed as to draw a smooth streamline for serving as the inner surface of the pipe and has a cross-sectional area equal to that of a space defined by the bulgy rounded concaved surface, and air screening dikes which are formed on both sides of the rounded raised portion, respectively.

1 Claim, 3 Drawing Sheets

MOUTHPIECE OF FLUTE

BACKGROUND OF THE INVENTION

1. Field of the Invention

The present invention relates to a mouthpiece of flute, and more particularly, to a mouthpiece of flute which is capable of easily giving a clear, vigorous, rich and loud sound and by means of which high-pitched tones of the scale of the flute can be obtained easily.

2. Description of the Prior Art

The present inventor has already studied and invented a mouthpiece of flute which is so designed as to be able to obtain a rich and good sound quality by dividing the interior space of a pipe into two parts including an acoustic space and a fluid space by forming a projective tongue portion without fail.

More specifically, in a mouthpiece 2*a* shown in FIG. 4, a continuous inner surface region extending from an edge 4*a* through the inner surface of a hole 3*a* to the upper portion of an inner surface 5*a* of a head pipe 1*a* is so formed as to be a streamlined surface 6*a* in order to make a laminar flow that is freed from any turbulent flow, and the inner surface of the hole 3*a* on this side on which a lip is to be put is made to extend downward into the head pipe 1*a* so as to form on the inner wall of the head pipe 1*a* a projective tongue portion 11*a* having the lower surface of which is formed by a concaved curved surface 12*a*, so that the interior space of the pipe is divided into two parts including an acoustic space A and a fluid space B.

An exhalation 7*a* sent forth through the gap between the lips is made to blow against the edge 4*a* and is therefore divided into halves as indicated by an inside vector 8*a* and an outside vector 9*a*. The air stream indicated by the inside vector 8*a* is made to flow along the edge 4*a*, the streamlined surface 6*a* and the inner surface 5*a* of the pipe in the mentioned order. Then, it is noted that a sound is produced when the air blown against the edge 4*a* vibrates in the vertical direction in the acoustic space A. Namely, the streamline indicated by the inside vector 8*a* becomes a laminar flow without forming any turbulent flow, and moreover, this flow swirls along the concaved curved surface 12*a* of the projective tongue portion 11*a* within the head pipe 1*a* so as to become a helical flow which in turn runs forwardly within the head pipe 1*a*. Due to this helical flow, an inward inflow vector 10*a* going from the hole 3*a* toward the inner part acts as if it causes a kind of vortex absorption, and this inflow vector 10*a* flows into a region of the fluid space B located below the projective tongue portion 11*a* so as to be joined with the helical flow of the inside vector 8*a*.

In the case of the above-described mouthpiece of flute, however, since the fluid space is expanded outwardly to become a bulging enlarged space, a vortex effect resulting from the helical flow generating in the fluid space is great so that it is indeed possible to obtain a clear, vigorous, rich and loud sound quality sufficiently, but it was found, on the other hand, that the high-pitched tones of the scale of the flute are troubled.

Further, the hole of the mouthpiece is provided with what is called undercut so as to be formed in a divergent nozzle-like tapered hole having the diameter of which is increased gradually from the outer open end to the inner open end, so that it is possible to give a rich and loud sound. However, it was found that if the degree of taper of this undercut is made large excessively it becomes impossible to give the highest-pitched tone as is the case of the above-described enlarged space.

In the above-described mouthpiece of flute, however, since the inner surface of the hole 3*a* on this side is made to extend downward into the head pipe 1*a* so as to form on the inner wall of the head pipe 1*a* the projective tongue portion 11*a* the lower surface of which is formed by the concaved rounded surface 12*a*, the interior space of the head pipe 1*a* is narrowed by the projective tongue portion 11*a*. Since the fluid space B is narrowed in particular, the function of joining the inflow vector 10*a* with the inside vector 8*a* within the fluid space B is not sufficient, resulting in that the vortex effect due to which the resistance to exhalation is reduced is deteriorated, thereby making it impossible to obtain a clear, vigorous and rich sound quality satisfactorily.

To cope with this, the present inventor has studied and invented another mouthpiece of flute which is capable of eliminating the above-described problems.

More specifically, in a mouthpiece of flute shown in FIG. 5, a projective tongue portion 11*a* is provided in such a manner that, in a position where the inner surface of a hole 3*a* on this side on which a lip is to be put meets the inner surface of a head pipe 1*a*, a bulgy rounded concaved surface 12*a* is formed so as to be made to bulge outwardly of the head pipe 1*a*, and the interior space of the pipe 1*a* is divided into two parts including an acoustic space A and a fluid space B.

SUMMARY OF THE INVENTION

An object of the present invention is to provide a mouthpiece of flute which is capable of not only giving a clear, vigorous, rich and loud sound easily but also obtaining the highest-pitched tone of scale of the flute without difficulty while overcoming the above-described problems.

To achieve this end, there is provided according to the present invention a mouthpiece of flute in which a projective tongue piece is formed in a position where the inner surface of a hole on this side on which a lip is to be put meets the inner surface of a head pipe so as to form a bulgy rounded concaved surface which is made to bulge outwardly of the head pipe, the interior space of the pipe is divided into two parts including an acoustic space and a fluid space by means of the projective tongue piece, and the inner surface of the head pipe in the vicinity of the hole comprises a rounded raised portion which is so formed as to draw a smooth streamline for serving as the inner surface of the pipe and has a cross-sectional area equal to that of a space defined by the bulgy rounded concaved surface, and air screening dikes which are formed on both sides of the rounded raised portion.

According to the mouthpiece of flute having the above-described structure, since the fluid space is expanded outwardly to become a bulging enlarged space, a vortex effect resulting from a helical flow generating in the fluid space is great so that it is possible to obtain a clear, vigorous, rich and loud sound quality sufficiently and, at the same time, since the rounded raised portion having a vertical-sectional area equal to that of the portion defined by the bulgy rounded concaved surface is formed on the inner surface of the head pipe in such a manner that a smooth streamline can be drawn by the inner surface of the pipe, even if the portion defined by the bulgy rounded concaved surface formed in the inner surface of the pipe is made lager, there is no possibility that high-pitched tones are missing, that is, it is possible to give the highest-pitched tone of the scale of the flute without difficulty.

Further, since the air screening dikes are formed on both sides of the rounded raised portion respectively, the air stream indicated by the inside vector can be prevented from branching off to both right and left at the rounded raised portion to become irregular flows, with the result that it is possible to obtain a vigorous and rich sound quality at all times.

DETAILED DESCRIPTION OF THE PREFERRED EMBODIMENT

Figure 2:
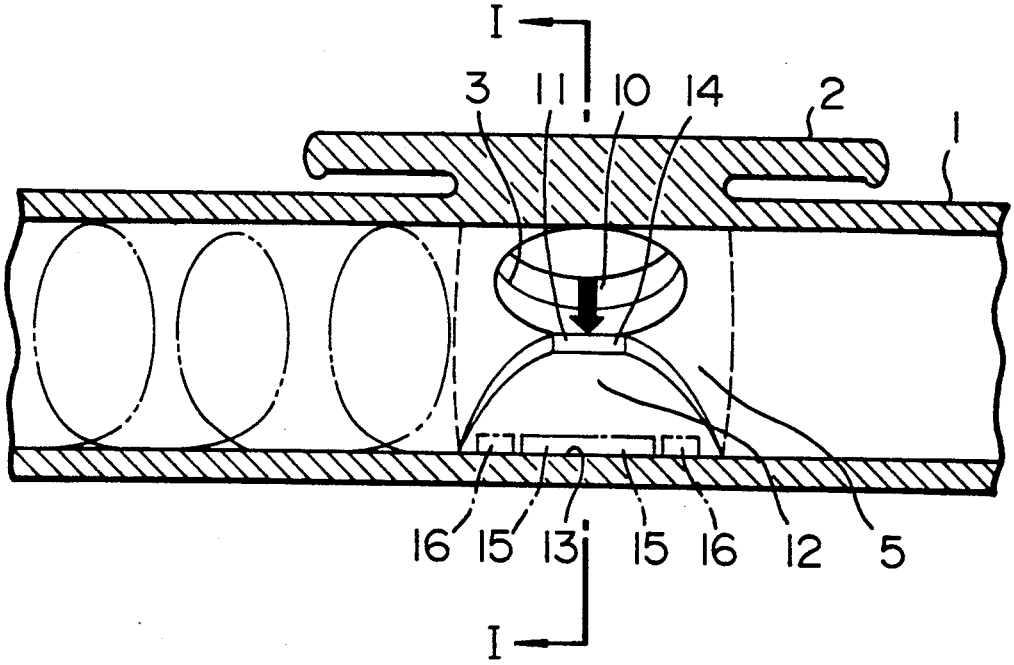
FIG. 2 is a vertical sectional view taken along the line II—II of FIG. 1 and showing the mouthpiece of flute and its surrounding portion.
Figure 3:
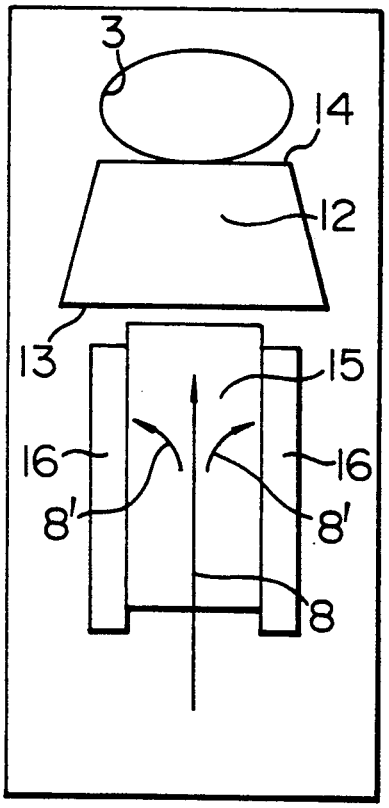
FIG. 3 is a development view showing the inside of the mouthpiece of flute shown in FIG. 1.
Figure 4:
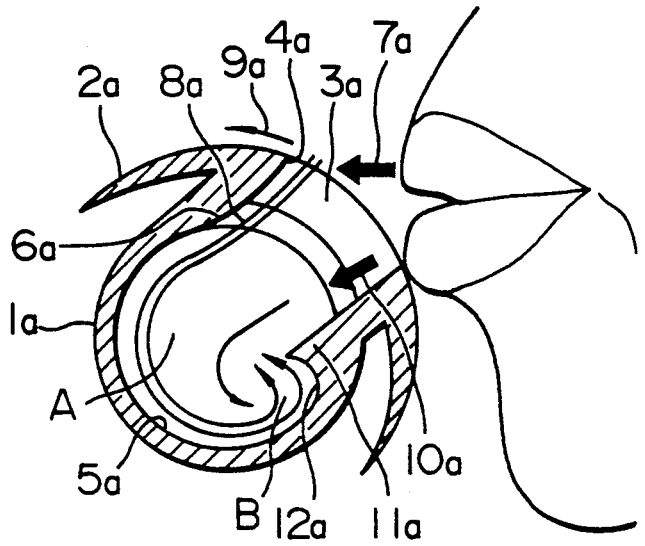
FIG. 4 PRIOR ART
FIG. 4 is a cross-sectional view of a conventional mouthpiece of flute.
Figure 5:
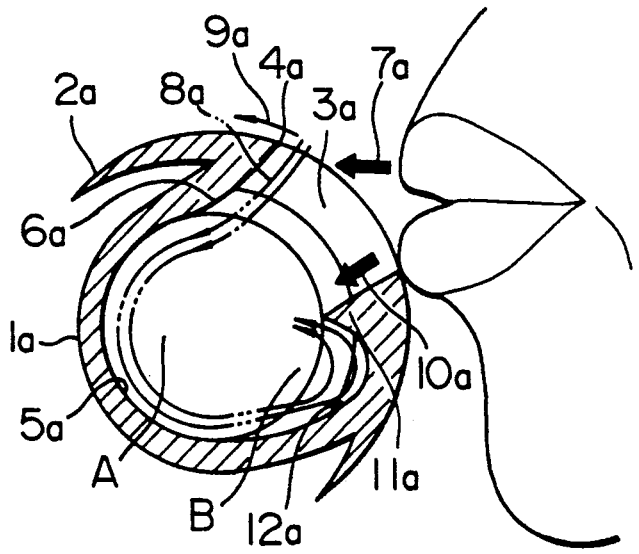
FIG. 5 PRIOR ART
FIG. 5 is a cross-sectional view of another conventional mouthpiece of flute.

An embodiment of the present invention will be described below with reference to FIGS. 1 to 3.

In the drawings, reference numeral 2 denotes a mouthpiece formed on a flute. A continuous inner surface region extending from an edge 4 through the inner surface of a hole 3 to the upper portion of an inner surface 5 of a head pipe 1 is so formed as to be a streamlined surface 6 in order to make a laminar flow that is freed from any turbulent flow.

Figure 1:
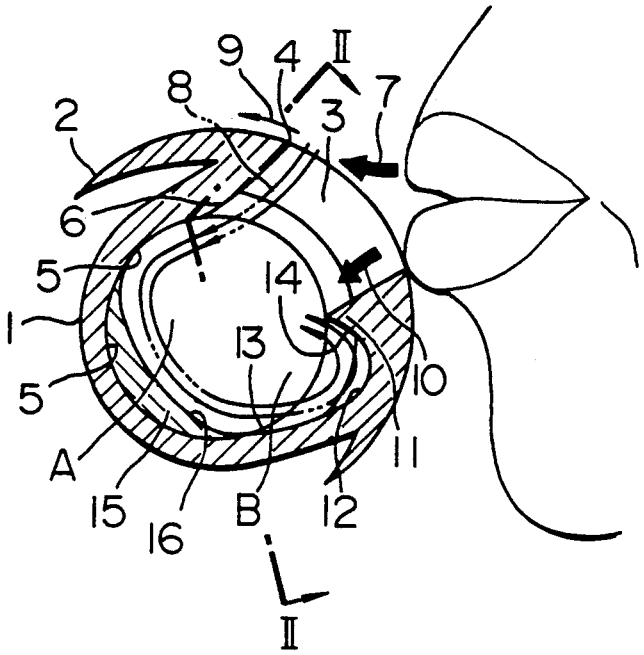
FIG. 1 is a cross-sectional view of a mouthpiece of flute according to an embodiment of the present invention taken along the line I—I of FIG. 2.

In this mouthpiece 2, in a position where the inner surface of the hole 3 on this side on which a lip is to be put meets the inner surface of the head pipe 1, a delta-shaped bulgy rounded concaved surface portion 12 having the width of which is gradually converged from a lower edge piece 13 toward an upper edge piece 14 thereof due to provision of a projective tongue piece 11, is so formed as to be made to bulge outwardly of the head pipe 1 as shown in FIG. 1. The interior space of the head pipe 1 is divided into two parts including an acoustic space A and a fluid space B, and however, since the boundary between them is a gaseous wall it doesn't hinder the sounds from being transmitted to the fluid space B at all.

In the above-described mouthpiece 2 of the flute, a rounded raised portion 15 and air screening dikes 16 are formed on the inner surface of the head pipe 1 in the portion of the inner surface which is confronted with the hole 3. The rounded raised portion 15 has a cross-sectional area which is equal to an inner cross-sectional area defined by the bulgy rounded concaved surface 12. The surface of the rounded raised portion 15 is so formed as to draw a smooth streamline for serving as the inner surface of the pipe. And, on both sides of the rounded raised portion 15 are formed the air screening dikes 16 as shown in FIG. 3, so that an air stream indicated by an inside vector 8 can be prevented from irregularly flowing out to both right and left as branch flows 8', 8'.

Incidentally, a breath sent forth through the lips is made to flow in the arrow mark directions as indicated by an exhalation 7, an outside vector 9 and an inflow vector 10 in FIG. 1.

In the mouthpiece of the flute according to the present invention, since the fluid space B is expanded outwardly to become a bulging enlarged space, a vortex effect resulting from a helical flow generating in the fluid space B is great so that it is possible to obtain a clear, vigorous, rich and loud sound quality sufficiently and, at the same time, since the rounded raised portion 15 having a vertical-sectional area which is equal to that of the portion defined by the bulgy rounded concaved surface 12 is formed on the inner surface of the head pipe 1 in such a manner that a smooth streamline can be drawn by the inner surface of the pipe, even if the portion defined by the bulgy rounded concaved surface 12 formed in the inner surface of the pipe is made larger, there is no possibility that high-pitched tones are missing, that is, it is possible to easily give the highest-pitched tone of the scale of the flute.

Further, even if the degree of taper of the undercut of the hole 3 formed in the mouthpiece 2 is made large excessively so as to give a vigorous, rich and loud sound, there is caused no problem that it becomes impossible to give the highest-pitched tone. In addition, since the air screening dikes 16 are formed on both sides of the rounded raised portion 15 respectively, the air stream indicated by the inside vector 8 can be prevented from branching off to both right and left at the rounded raised portion 15 to becomes irregular flows, with the result that it is possible to obtain a vigorous and rich sound quality at all times.

Moreover, according to the mouthpiece 2 of the present invention, not only the amplitude of sound accent can be widened but also it is possible to give a feeble sound as well without difficulty. And, sine a negative pressure is produced in the pipe due to vortex effect the amount of exhalation to be absorbed becomes greater as compared with the conventional pipe, with the result that what is called breathing efficiency can be increased remarkably.

What is claimed is:

1. A mouthpiece of flute in which a projective tongue piece is formed in a position where the inner surface of a hole on this side on which a lip is to be put meets the inner surface of a head pipe so as to form a bulgy rounded concaved surface which is made to bulge outwardly of the head pipe, and the interior space of said pipe is divided by said projective tongue piece into two pats including an acoustic space and a fluid space, wherein the inner surface of said head pipe in the vicinity of the hole comprises a rounded raised portion which is so formed as to draw a smooth streamline for serving as the inner surface of said pipe and has a cross-sectional area equal to that of a space defined by said bulgy rounded concaved surface, and air screening dikes which are formed on both sides of said rounded raised portion, respectively.

* * * * *